US005370479A

United States Patent [19]

Akesaka

[11] Patent Number: 5,370,479

[45] Date of Patent: Dec. 6, 1994

[54] SHIELDING APPARATUS

[75] Inventor: Toshio Akesaka, Kanagawa, Japan

[73] Assignee: Kabushiki Kaisha Iseki Kaihatsu Koki, Tokyo, Japan

[21] Appl. No.: 72,169

[22] Filed: Jun. 4, 1993

[30] Foreign Application Priority Data

Jun. 5, 1992 [JP] Japan ..... 4-169863

[51] Int. Cl.[5] ..... E21B 11/00

[52] U.S. Cl. ..... 405/138; 175/19; 175/94

[58] Field of Search ..... 175/19, 55, 62, 94, 175/343; 405/138, 146

[56] References Cited

U.S. PATENT DOCUMENTS 3,926,267 12/1975 Svirschevsky et al. .
4,230,191 10/1980 Svirschevsky ..... 175/20
4,624,605 11/1986 Akesaka .
5,031,707 7/1991 Gerasimenko et al. ..... 175/19

FOREIGN PATENT DOCUMENTS 0122540 10/1984 European Pat. Off. ..... E21D 9/06
0352349 1/1990 European Pat. Off. ..... E21D 9/08
0409092 1/1991 European Pat. Off. ..... E21D 9/06
59-192193 of 1984 Japan ..... E21D 9/06

OTHER PUBLICATIONS

European Search Report, Hector Fonseca, Aug. 20, 1993, Application No. EP 93 30 4172, (3 pages).

*Primary Examiner*—William P. Neuder
*Attorney, Agent, or Firm*—Webb Ziesenheim Bruening Logsdon Orkin & Hanson

[57] ABSTRACT

A shielding apparatus comprises a cylindrical shield body, a crankshaft supported by the shield body rotatably around the axis of the shield body, a plurality of rotors successively provided in the direction of the axis in a front region ahead of the shield body and a driving mechanism for rotating the crankshaft around the axis, wherein the rotors define the outer surface of an approximately conical or truncated conical shape in conjunction with each other, and the adjoining rotors are made eccentric with respect to the axis of the shield body in the different directions from each other.

9 Claims, 3 Drawing Sheets

SHIELDING APPARATUS

BACKGROUND OF THE INVENTION

1. Field of the Invention

This invention relates to a shielding apparatus used in case of constructing horizontal and vertical holes, tunnels or the like under the ground.

2. Description of the Prior Art

As one of shielding apparatuses for constructing tunnels or the like without excavating the ground by consolidating the ground as in case of using a pile driving machine, there is a disclosure of such an apparatus that comprises a cylindrical shield body, a crankshaft supported by the shield body rotatably around the axis of the shield body and having an eccentric portion, a rotor provided in front of the shield body and rotatably supported by the eccentric portion of the crankshaft, tile rotor having an external surface in an approximately conical or truncated conical form, and a driving mechanism for rotating the crankshaft around the axis of the shield body (Japanese Pat. Public Disclosure (KOKAI) No. 59-192193) corresponding to U.S. Pat. No. 4,624,605.

This shielding apparatus known per se is advanced by a pipe-propelling device disposed in the starting shaft or the like while the crankshaft is rotated by the driving mechanism. The rotor makes a revolving motion (revolution) around the rotational axis of the crankshaft in accordance with the rotation of the crankshaft, and also makes a rotary motion (rotation) about the eccentric portion of the crankshaft by rotating about the eccentric portion of the crankshaft while bringing the outer circumferential surface of the rotor into contact with the ground. Accordingly, the shielding apparatus known per se forms holes such as tunnels into the ground by being advanced while consolidating the ground by the outer surface of the rotor.

In this kind of shielding apparatus, a reaction force in the radial direction of the shield body or a hole to be formed is yielded on the rotor in accordance with the consolidation of the ground by the rotor. The reaction force acts on the shield body such that the shield body is pushed against the ground so as to yield a frictional force between the shield body and the ground when the shield body advances. The strength of such a frictional force gives a great influence on a thrust required for the advancement of the shield body.

However, since only one rotor is used, in the above-mentioned shielding apparatus known per se, the reaction force acts on the shield body as it is. As a result, a frictional force between the shield body and the ground is large, and therefore a large thrust is necessary for the advancement of the shield body. Furthermore, the above-mentioned reaction force acts on the shield body as a bending moment, and therefore the advancing direction of the apparatus is unstable.

As one of other apparatuses for constructing tunnels or the like without excavating the ground by consolidating the ground, there is a disclosure (U.S. Pat. No. 3,926,267) of such an apparatus that comprises a driving mechanism, a crankshaft rotated by the driving mechanism, and a plurality of rotors provided in front of the driving mechanism and rotatably supported by the crankshaft. The driving mechanism is provided with a casing and a plurality of projection portions protruding from the casing so as to touch on the inner surface of a hole formed by the revolving and rotary motions of the rotors.

In this apparatus known per se, the casing of the driving mechanism has an outer diameter smaller than the inner diameter of the hole to be formed. For this reason, in the process of the hole being forming, the hole around the casing is kept by the ground consolidated around the hole, and the rotational reaction force caused by the revolving and rotary motions of the rotors is transmitted to the ground through the projection portions.

In such an apparatus using the casing having the outer diameter smaller than the inner diameter of the hole to be formed in this manner, however, the casing does not contact the ground around the hole. Therefore, there is no problem brought by any frictional force caused by the reaction force in the radial direction of the hole.

However, in the apparatus using the casing having the outer diameter smaller than the inner diameter of the hole to be formed in this manner, since the casing has not action for preventing the ground about the hole from caving in, the ground about the hole cannot be prevented from caving in. Accordingly, the above-mentioned apparatus is not practical.

SUMMARY OF THE INVENTION

It is an object of the present invention to provide a shielding apparatus which can stabilize the advancing direction of the apparatus by minimizing a reaction force acting on a shield body in the radial direction thereof when the ground is consolidated, and by reducing a frictional force between the ground and the shield body caused by the reaction force.

A shielding apparatus of the present invention comprises: a cylindrical shield body; a crankshaft supported by the shield body rotatably around the axis of the shield body; a plurality of rotors successively disposed in the axial direction of the shield body in a front region ahead of the shield body and rotatably supported by the crankshaft; and a driving mechanism for rotating the crankshaft around the axis of the shield body, wherein the rotors define an approximately conical or truncated conical outer surface in conjunction with each other, and the adjoining rotors are made eccentric with respect to the axis of the shield body in the different directions from each other.

The shielding apparatus is advanced by a pipe-propelling mechanism or the like while the crankshaft is rotated by the driving mechanism. Each rotor makes a revolving motion (revolution) around the axis of the rotation of the crankshaft in accordance with the rotation of the crankshaft, and also makes a rotary motion (rotation) around the axis of the eccentric portion of the crankshaft by revolving while bringing the outer circumferential surface into contact with the ground. Accordingly, the shielding apparatus forms holes such as tunnels into the ground by being advanced while consolidating the ground by the outer surface of the rotors.

When the ground is consolidated, a reaction force in the radial direction of the shield body yields on each rotor. However, since the adjoining rotors are made eccentric with respect to the axis of the shield body in the different directions from each other, the direction of the reaction force is various every rotor. Since the reaction force yielded on each rotor is thereby offset by each other, the reaction force acting on the shield body becomes smaller. As a result, the frictional force caused between the ground and the shield body caused by the reaction force acting on the shield body becomes smaller, and the thrust required for the advancement of the shield body becomes smaller. Furthermore, since the bending moment acting on the shield body becomes smaller in proportion to the decrease in the reaction force, the advancing direction of the apparatus is stabilized.

According to the present invention, as described above, since a plurality of rotors are used and the adjoining rotors are made eccentric with respect to the axis of the shield body in the different directions from each other, reaction force yielded on each rotor when the ground is consolidated is offset by each other. As a result, since a reaction force acting on the shield body in the radial direction becomes smaller, a frictional force between the ground and the shield body caused by the reaction force becomes smaller and a bending moment acting on the shield body becomes smaller. As a result, the advancing direction of the apparatus is stabilized.

It is preferable that the shield body is provided with a cylindrical portion and a wall portion provided at the front end of the cylindrical portion and dividing the interior of the cylindrical portion from a front region of the shield body, and that the crankshaft is rotatably supported by the wall portion. Accordingly, it can prevent earth and sand from getting into the shield body.

It is preferable to make the adjoining rotors eccentric with respect to the axis of the shield body directions opposite to each other. Since the reduced quantity in the reaction forces thereby becomes larger, the reaction force acting on the shield body, and in its turn the resulting frictional force between the shield body and the ground becomes smaller.

The crankshaft may be provided with a plurality of eccentric portions adjoining in the front region and for supporting the rotors respectively. The eccentric portions are formed successively in the axial direction of the crankshaft, and the adjoining eccentric portions are made eccentric with respect to the axis of the shield body in the different directions from each other.

It is preferable to further comprise a mechanical seal continuously extending around the crankshaft, arranged corresponding to the adjoining rotors and acting as a seal between the adjoining rotors, and another mechanical seal extending continuously around the crankshaft, arranged corresponding to both the shield body and the rotor disposed near to the shield body and acting as a seal between the shield body and the rotor disposed near to the shield body. Accordingly, although the adjoining shield body, rotors and the rotor disposed near to the shield body relatively move in the radial direction of the shield body, earth and sand is prevented from getting into the gap between the rotors and the crankshaft through the gaps between the adjoining rotors and between the shield body and the rotor disposed near to the shield body.

It is preferable to mount a cutter portion on the front end of the rotor located at the tip end of the shielding apparatus which excavates the earth and sand about the axis of the rotor in accordance with the rotation of the rotor. Since the ground about the axis of the shield body is excavated, the rectilinear ability of the shield body is improved and a necessary thrust becomes smaller in comparison with those in case where the ground about the axis of the shield body is not excavated.

It is preferable that the cylindrical portion has a first cylindrical portion provided with a wall portion and a second cylindrical portion connected to the first cylindrical portion by a plurality of jacks arranged at intervals around the axis. Accordingly, the advancing direction of the apparatus can be corrected easily and accurately in cooperation with the fact that a plurality of rotors are arranged to be eccentric with respect to the axis of the shield body in the different directions from each other.

BRIEF DESCRIPTION OF THE DRAWINGS

The foregoing and other objects and features of the invention will become apparent from the following description of a preferred embodiment of the invention with reference to the accompanying drawings, in which.

DETAILED DESCRIPTION OF THE PREFERRED EMBODIMENT

Figure 1:
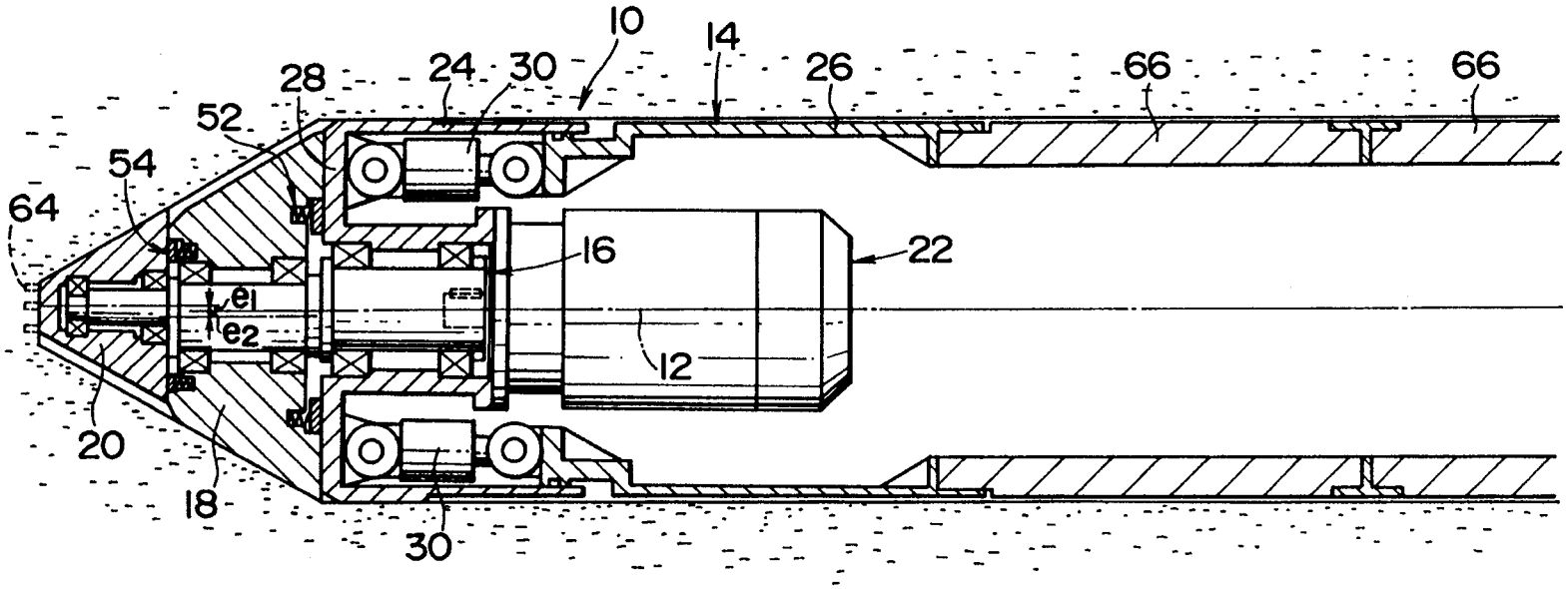
FIG. 1 is a sectional view showing a shielding apparatus as a preferred embodiment of the present invention.
Figure 2:
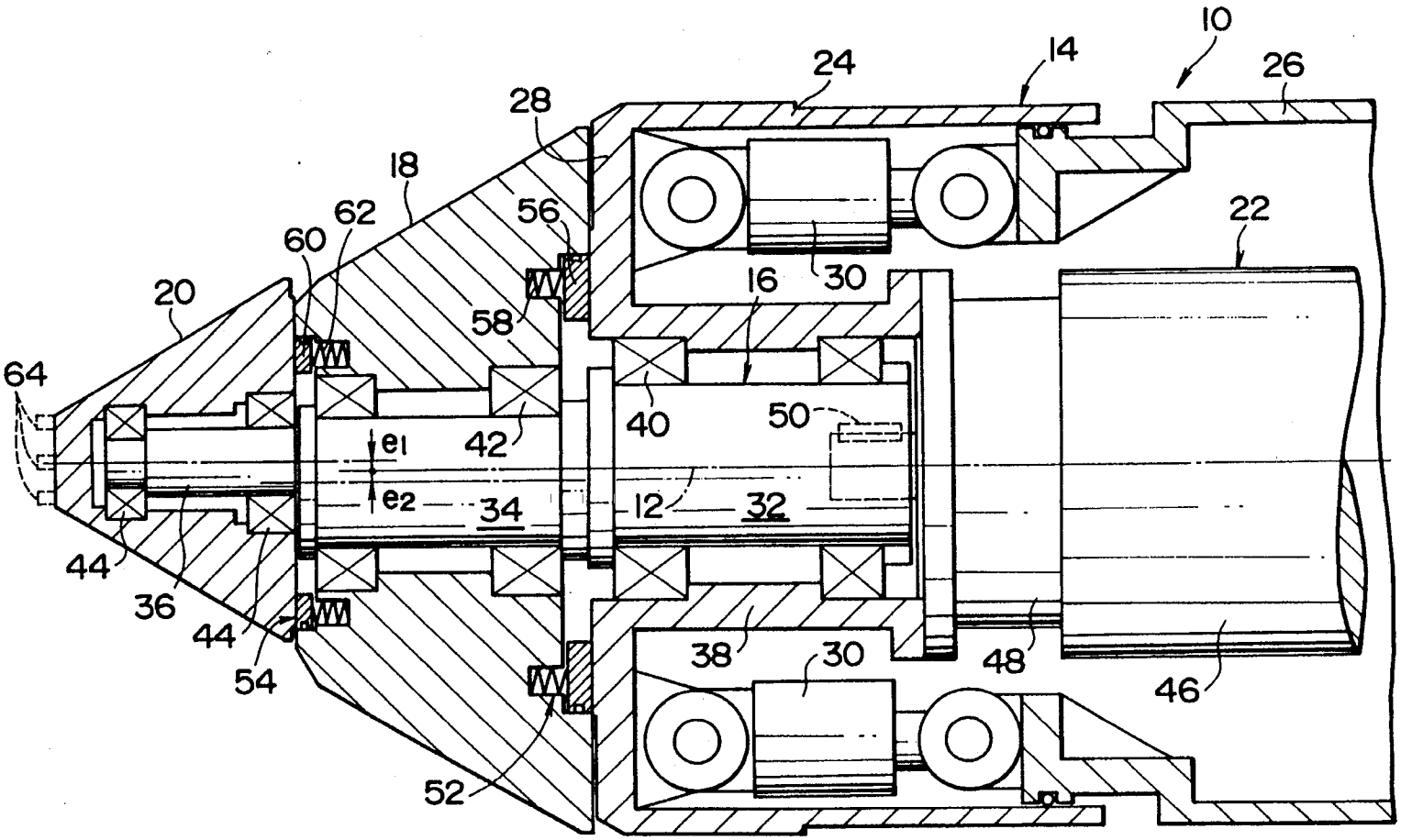
FIG. 2 is a partially enlarged sectional view showing the shielding apparatus of FIG. 1.

Referring now to FIGS. 1 and 2, a shielding apparatus 10 comprises a cylindrical shield body 14 having an axis 12, a crankshaft 16 supported by the shield body 14 rotatably around the axis 12, a plurality of rotors 18 and 20 successively arranged in a front region ahead of the shield body 14 in the direction of the axis 12 and rotatably supported by the crankshaft 16, and a driving mechanism 22 for rotating the crankshaft 16 around the axis 12.

The shield body 14 is provided with a first cylindrical portion 24, a second cylindrical portion 26 partially fitted to the rear end of the first cylindrical portion 24, a wall portion 28 mounted on the front end of the first cylindrical portion 24 and for dividing the interior of the shield body 14 from the front region ahead of the shield body 14, and a plurality of hydraulic jacks 30 arranged at angular interval around the axis 12 and for connecting the first and second cylindrical portions 24 and 26 to each other.

The direction of the cylindrical portion 26 to the first cylindrical portion 24 is corrected by extending or contracting at least one jack 30 by a predetermined quantity as it has been known per se. The advancing direction of the shielding apparatus 10 is thus corrected.

The crankshaft 16 has a main shaft portion 32 and a plurality of eccentric portions 34 and 36 successively continuing to one end of the main shaft portion 32, and is supported by a plurality of bearings 40 to a boss portion 38 formed in the wall portion 28 so that the eccentric portions 34 and 36 are projected forwards from the wall portion 28. The rotors 18 and 20 are supported by a plurality of bearings 42 and 44 to the eccentric portions 34 and 36, respectively. The rotors 18 and 20 are formed in such a form that defines the outer surface of an approximately conical or truncated conical shape in conjunction with each other.

In the illustrated embodiment, two rotors 18 and 20 are provided, and accordingly, two eccentric portions 34 and 36 are formed in the crankshaft 16. Therefore, in the illustrated embodiment, the rotors 18 and 20 are made eccentric with respect to the axis 12 by $e_1$ and $e_2$in the directions opposite to each other. However, three or more rotors may be used.

The driving mechanism 22 is provided with a source of rotation 46 such as a motor and a reduction gear 48 connected to the source of rotation. The driving mechanism 22 is mounted on the boss portion 38 by a plurality of bolts (not shown) and connected to the main shaft portion 32 of the crankshaft 16 by a key 50 in the output axis of the reduction gear 48.

The space where the bearings 40, 42 and 44 are arranged is filled with lubricating oil. In order to protect the lubricating oil from earth and sand, mechanical seals 52 and 54 are arranged between the wall portion 28 and the rotor 18 and between the adjoining rotors 18 and 20, respectively. Further, a seal member (not shown) is arranged between the driving mechanism 22 and the boss portion 38.

The mechanical seal 52 is provided with a ring 56 arranged in a recess formed on the rear surface of the rotor 18 and extending around the crankshaft 16 and a plurality of compressed coil springs 58 for pressing the ring against the front surface of the wall portion 28. Each spring 58 is arranged in a recess formed on the rotor 18 at equal angular intervals around the axis 12. However, the ring 56 and the springs 58 may be provided at the wall portion 28 so as to press the ring 56 against the rear surface of the rotor 18.

The mechanical seal 54 is provided with a ring 60 arranged in a recess formed on the front surface of the rotor 18 and extending around the crankshaft 16 and a plurality of compressed coil springs 62 for pressing the ring against the rear surface of the rotor 20. Each spring 62 is arranged in a recess formed on the rotor 18 at equal angular intervals around the axis 12. However, the ring 60 and the springs 62 may be arranged in the rotor 20 so as to press the ring 60 against the front surface of the rotor 18.

Furthermore, a cutter portion 64 for excavating the earth and sand about the axis 12 in accordance with the rotation of the rotor 20 may be provided at the front end of the rotor 20 located at the tip end of the shielding apparatus.

Since the illustrated embodiment is described as a shielding apparatus used in a pipe propelling method, the shielding apparatus 10 is advanced together with a pipe 66 by receiving a thrust from the pipe-propelling mechanism or the like through one or more pipes 66 continuing to the rear portion of the shield body 14. However, the advancement of the shielding apparatus may be carried out by a plurality of jacks arranged between the pipe 66 mounted on the tip end and the rear portion of the shield body 14.

While the shielding apparatus 10 is receiving the thrust, the crankshaft 16 is rotated by the rotation mechanism 22. The rotors 18 and 20 make a revolving motion (revolution) around the axis 12 in accordance with the rotation of the crankshaft 16, respectively, and also make a rotary motion (rotation) around the axes of the eccentric portions 32 and 34 of the crankshaft 16 by revolving while bringing tile outer circumferential surfaces into contact with the ground. As a result, the shielding apparatus 10 forms holes such as tunnels into the ground by being advanced while consolidating the ground by the outer surface of the rotors 18 and 20.

When the ground is consolidated, a reaction force in the radial direction of the shield body 14 is yielded on the rotors 18 and 20. When the reaction force is transmitted to the shield body 14 as it is, the shield body 14 is strongly pressed against the ground. Therefore, a large frictional force is yielded between the shield body 14 and the ground, and as a result, a large thrust is required for the advancement of the shield body 14.

Since the adjoining rotors 18 and 20 in the shielding apparatus 10 are made eccentric with respect to the axis 12 in directions opposite to each other, the direction of the reaction force on the rotor 18 is opposite to that of the reaction force on the rotor 20. Thereby, the reaction forces on the rotors 18 and 20 are offset by each other, and therefore, the reaction force acting on the shield beady 14 becomes smaller. As a result, the frictional force between the ground and the shield body caused by the reaction force becomes smaller, and the thrust required for the advancement of the shield body becomes smaller.

If the directions of the reaction forces yielding on the rotors are same with each other, the reaction forces act on the shield body as a bending moment. When such a bending moment acts on the shield body, the advancing direction of the shielding apparatus becomes unstable. In particular, in the illustrated embodiment, in the case of an apparatus for correcting the advancing direction of the shielding apparatus by correcting the direction of the first cylindrical portion 24 to the second cylindrical portion 26 by means of a jack 30, the advancing direction of the shielding apparatus 10 becomes unstable due to the bending moment acting on the shield body. As a result, the directional correction has to be frequently carried out, the operation for correcting the direction becomes complicated and the control of the direction becomes unstable.

In the shielding apparatus 10, however, since the directions of the reaction forces yielding on the rotors 18 and 20 are offset by each other, the reaction forces of the rotors 18 and 20 are reduced by each other, and therefore, a reaction force acting on the shield body 14 as a bending moment becomes smaller. As a result, the advancing direction of the shielding apparatus 10 is stabilized. Furthermore, although the apparatus is designed so as to be particularly controllable in direction, the advancing direction of the shielding apparatus 10 is stabilized, the frequency of directional correction is decreased, the operation for correcting the direction becomes easy and the control of the direction is stabilized.

Figure 3:
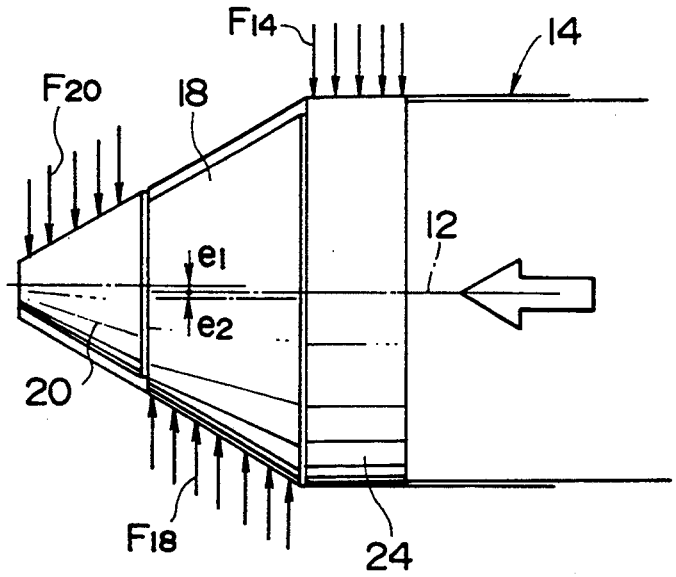
FIG. 3 is an explanatory view showing reaction forces.
Figure 4:
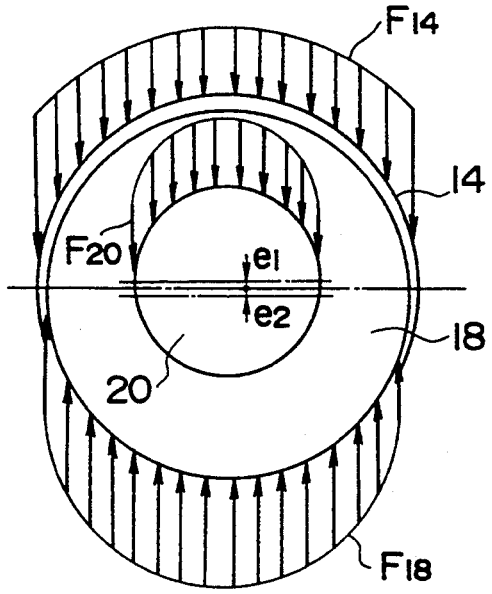
FIG. 4 is a perspective view from the left side in FIG. 3 and an alternate explanatory view showing the reaction forces.

In the illustrated embodiment, as shown in FIGS. 3 and 4, a reaction force F18 of the rotor 18 is divided into a reaction force F14 acting on the shield body 14 and another reaction force F20 acting on the rotor 20. The reaction force F14 acting on the shield body 14 is remarkably reduced in comparison with that in case where the rotors 18 and 20 are made eccentric with respect to the axis of the shield body in the same direction. That is, in the illustrated embodiment, the reaction force F14 acting on the shield body 14 is given by:

$$F14 = F18 - F20$$

However, in case where the rotors 18 and 20 are made eccentric with respect to the axis of the shield body in the same direction, the reaction force F14 is given by;

$$F14 = F18 + F20$$

The ratio of the reaction force F14 to the reaction force F20 is determined by the ratio of the pressure receiving area of the shield body 14 to the pressure receiving area of the rotor 20. The reaction force F14 acting on the shield body 14 can be minimized by increasing the number of rotors to be used. In case of using three or more rotors, the rotors may be provided so that the eccentric directions of the rotors may be arranged at an equal angular interval about the axis 12. Otherwise, the rotors may be provided so that the eccentric directions of the adjoining rotors may be opposite to the axis 12.

What is claimed is:

1. A shielding apparatus, comprising:

a cylindrical shield body;

a crankshaft supported by said shield body for rotation around a longitudinal axis of said shield body;

a plurality of serially mounted rotors eccentrically disposed about said axis adjacent a front end of said shield body and rotatably supported by said crankshaft; and a driving mechanism for rotating said crankshaft around said axis;

wherein said rotors cooperate to define an approximately conical or truncated conical outer surface; and each rotor having a geometric rotor axis which is parallel to and spaced from said longitudinal shield body axis, the rotor axes of adjoining rotors being spaced in opposite directions from one another.

2. A shielding apparatus according to claim 1, wherein said shield body is provided with a cylindrical portion and a wall portion located at the front end of said shield body to separate the interior of said cylindrical portion from said rotors, and said crankshaft is rotatably supported by said wall portion.

3. A shielding apparatus according to claim 1, wherein said crankshaft has a plurality of eccentric portions successively formed in the direction of said axis for supporting said rotors, respectively, and adjoining eccentric crankshaft portions are eccentric with respect to the longitudinal axis of the shield body in opposite directions from each other.

4. A shielding apparatus according to claim 1, further comprising:

a first mechanical seal extending continuously around said crankshaft, corresponding to at least one pair of said adjoining rotors for acting as a seal between said adjoining rotors; and a second mechanical seal extending continuously around said crankshaft, corresponding to both said shield body and the rotor disposed nearest to the shield body for acting as a seal between the shield body and said nearest disposed rotor.

5. A shielding apparatus according to claim 1, wherein the rotor located at a tip end of the apparatus has a cutter portion located on a front end of said rotor for excavating the earth and sand about the crankshaft in accordance with the rotation of said rotor.

6. A shielding apparatus according to claim 2, wherein said cylindrical portion has a first cylindrical portion provided with said wall portion and a second cylindrical portion connected to the rear portion of said first cylindrical portion, and said first and second cylindrical portions being connected to each other by a plurality of jacks arranged at intervals around said axis.

7. A shielding apparatus according to claim 6, wherein said crankshaft has a pair of eccentric portions formed adjacent to each other for supporting said rotors, respectively, and said eccentric portions are displaced with respect to the axis of the shield body in opposite directions from each other.

8. The shielding apparatus of claim 1 consisting of two rotors.

9. The shielding apparatus of claim 1 wherein said shield body is advanced by receipt of a thrust at a rear portion of said shield body.

* * * * *

UNITED STATES PATENT AND TRADEMARK OFFICE

CERTIFICATE OF CORRECTION

PATENT NO. : 5,370,479

DATED : December 6, 1994

INVENTOR(S) : Toshio Akesaka

It is certified that error appears in the above-indentified patent and that said Letters Patent is hereby corrected as shown below:

Column 1 Line 19 "tile" should read --the--.

Column 2 Line 6 "forming" should read --formed--.

Column 2 Line 22 "not" should read --no--.

Column 3 Line 29 after "body" insert --in--.

Column 3 Line 53 "is" should read --are--.

Column 4 Line 44 "interval" should read --intervals--.

Column 4 Line 68 "$e_2$in" should read --$e_2$ in--.

Column 5 Line 60 "tile" should read --the--.

Column 6 Line 12 "beady" should read --body--.

Signed and Sealed this

Seventh Day of March, 1995

*Attest:*

Bruce Lehman

BRUCE LEHMAN

*Attesting Officer*

*Commissioner of Patents and Trademarks*